US006578508B2

(12) United States Patent
Hattori et al.

(10) Patent No.: US 6,578,508 B2
(45) Date of Patent: Jun. 17, 2003

(54) SMALL WATERCRAFT HULL AND ENGINE ARRANGEMENT

(75) Inventors: Toshiyuki Hattori, Shizuoka (JP); Masayoshi Nanami, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/078,198

(22) Filed: Feb. 14, 2002

(65) Prior Publication Data

US 2002/0160672 A1 Oct. 31, 2002

(30) Foreign Application Priority Data

Feb. 15, 2001 (JP) ..... 2001-038201

(51) Int. Cl.[7] ..... B63B 35/73
(52) U.S. Cl. ..... 114/55.57; 440/88; 440/89
(58) Field of Search ..... 114/55.57; 440/77, 440/78, 76, 88, 89

(56) References Cited

U.S. PATENT DOCUMENTS 5,743,206 A 4/1998 Hattori
5,778,833 A 7/1998 Kuranishi
5,931,712 A 8/1999 Hattori et al.
5,934,958 A 8/1999 Ochiai
5,954,553 A 9/1999 Ozawa et al.
5,957,072 A * 9/1999 Hattori ..... 114/55.57
6,089,932 A 7/2000 Nanami et al.
6,095,876 A 8/2000 Ozawa et al.
6,213,827 B1 4/2001 Hattori et al.
6,250,980 B1 * 6/2001 Ozawa ..... 440/88
6,322,409 B1 11/2001 Hattori et al.
6,346,019 B1 2/2002 Nanami

OTHER PUBLICATIONS

US 6,273,014, 8/2001, Suzuki (withdrawn)
Copending application entitled, *Hull for Small Watercraft*, application No. 10/078,027 filed on Feb. 14, 2002 in twenty (20) pages and six (6) pages of formal drawings.

* cited by examiner

*Primary Examiner*—Stephen Avila
(74) *Attorney, Agent, or Firm*—Knobbe Martens Olson & Bear LLP

(57) ABSTRACT

A small watercraft hull defines a vertically oriented, central longitudinal plane of the watercraft. The hull has an engine compartment with an internal combustion engine disposed therein. The engine has an engine body comprising a crankcase, a cylinder block and a cylinder head and includes at least one cylinder bore defining a cylinder axis. An air induction system is provided to guide air into a combustion chamber of the engine. The air induction system includes a plenum chamber. An exhaust system is also provided for guiding exhaust gases from the combustion chamber to the atmosphere. The exhaust system includes an exhaust conduit. The cylinder axis is canted with respect to the central plane and the exhaust conduit is disposed substantially on a side of the central plane to which the cylinder axis is canted. The plenum chamber is positioned on a side of the central plane opposite the exhaust conduit and extends substantially vertically from a position proximate the crankcase to a position proximate the cylinder head.

21 Claims, 11 Drawing Sheets

SMALL WATERCRAFT HULL AND ENGINE ARRANGEMENT

PRIORITY INFORMATION

This application is based on, and claims priority to, Japanese Patent Application No. 2001-038201, filed Feb. 15, 2001, the entire contents of which are expressly incorporated by reference herein.

BACKGROUND OF THE INVENTION

1. Field of the Invention

The present invention relates to small watercraft and, in particular, to an improved engine and component layout of a small watercraft which efficiently utilizes available space within an engine compartment of the watercraft hull.

2. Description of the Related Art

Personal watercraft have become very popular in recent years. This type of watercraft is quite sporting in nature and carries one or more riders. A relatively small hull of the personal watercraft defines a rider's area above an engine compartment. An internal combustion engine powers a jet propulsion unit, which propels the watercraft. The engine lies within the engine compartment in front of a tunnel formed on an underside of the hull. The jet propulsion unit, which includes an impeller, is placed within the tunnel. The impeller has an impeller shaft driven by the engine. The impeller shaft usually extends between the engine and the jet propulsion device through a bulkhead of the hull tunnel.

Personal watercraft with four-cycle engines are now being produced primarily for reducing exhaust emissions. The four-cycle engine desirably includes a plenum chamber that has a relatively large volume so as to obtain high performance under all running conditions. The four-cycle engine, however, has two or more valves and a valve drive mechanism arranged to activate the valves. Such a large plenum chamber, multiple valves and a valve drive mechanism, as well as the foregoing throttle bodies, are factors which make the engine larger in height and/or width. On the other hand, because the rider's area is defined above the engine compartment as noted above, the capacity and height of the engine compartment is limited. Otherwise, the seat position must be higher and/or wider which may not be comfortable for the rider.

Accordingly, it is important to make efficient use of the available space within the engine compartment defined by the hull of the watercraft so as to accommodate the necessary engine components within a hull sized to provide a comfortable seating position to the rider and any passengers. In addition, the overall center of gravity of the watercraft must be considered in the engine arrangement so as not to negatively affect the watercraft's handling. Furthermore, with the limited access to the engine compartment, the engine and component arrangement preferably accommodates access to components of the engine which require routine maintenance.

SUMMARY OF THE INVENTION

One aspect of the present invention involves a small watercraft comprising a hull defining a vertically oriented, central longitudinal plane of the watercraft. The hull has an engine compartment with an internal combustion engine disposed therein. The engine has an engine body comprising a crankcase, a cylinder block and a cylinder head. The engine body includes at least one cylinder bore defining a cylinder axis. An air induction system is configured to guide air into a combustion chamber of the engine and comprises a plenum chamber. An exhaust system is provided for guiding exhaust gases from the combustion chamber to the atmosphere and comprises an exhaust conduit. The cylinder axis is canted with respect to the central plane and the exhaust conduit is disposed substantially on a side of the central plane to which the cylinder axis is canted. The plenum chamber is positioned on a side of the central plane opposite the exhaust conduit and extends substantially vertically from a position proximate the crankcase to a position proximate the cylinder head.

With such an arrangement, the available space within the engine compartment is advantageously utilized in an efficient manner. By canting the engine with respect to the central plane of the watercraft, the height of the engine is reduced, which allows the seat height of the watercraft to remain desirably low and provides a space above the engine for other components to be positioned. In addition, lowering the height of the engine lowers the overall center of gravity of the watercraft for improved handling. Further, by positioning the exhaust conduit on the side of central plane to which the engine is canted, a large amount of space is created on the opposite side of the engine. This space may be utilized to provide a relatively large plenum chamber for improved power output of the engine.

An additional aspect of the present invention involves a small watercraft comprising a hull including a pedestal for supporting a seat assembly. The hull additionally has an engine compartment with an internal combustion engine disposed therein. The engine has an engine body and an air induction system configured to guide air into a combustion chamber of the engine. The air induction system includes an air intake box defining a plenum chamber, which extends substantially vertically along a side of the engine body. A side of the air intake box facing the pedestal includes an access opening. The pedestal also includes a hull opening sized, shaped and positioned to permit access to the access opening of the air intake box.

Advantageously, such an arrangement permits convenient access to the plenum chamber, or interior, of the air intake box. Thus, components within the air intake box that may require service, such as the fuel injectors, throttle bodies, and especially the filter assembly. In addition, this arrangement permits the air intake box to be positioned beside the engine body and remain accessible. This provides flexibility in the engine and component layout which would not be possible if access to the engine compartment (and, thus, the air intake box) was available only through an upper opening in the hull below the seat assembly, as in many prior watercraft hull designs.

Another aspect of the present invention involves a small watercraft comprising a hull defining a vertically oriented, central longitudinal plane of the watercraft and including a pedestal for supporting a seat assembly. The hull additionally has an engine compartment and an internal combustion engine disposed therein. The engine has an engine body and an exhaust system for guiding exhaust gases from the combustion chamber to the atmosphere. The exhaust system includes an exhaust conduit having a portion passing along a side of the engine body. The pedestal includes a hull opening. At least a portion of the exhaust conduit protrudes outward through a plane defined by the hull opening. The hull additionally comprising a removable cover closing the hull opening, the cover being outwardly curved away from the pedestal to accommodate the exhaust conduit.

Such an arrangement advantageously permits additional space within the engine compartment to accommodate the exhaust conduit. In addition, the exhaust conduit may be made larger in cross sectional area to improve power output of the engine. The engine may also be canted at a greater angle than otherwise possible, to further lower the overall center of gravity of the watercraft. The opening in the hull also provides improved access to engine components within the engine compartment, including, for example, an oil filter of the engine.

BRIEF DESCRIPTION OF THE DRAWINGS

The above-mentioned and other features of the present invention are described below with reference to drawings of preferred embodiments of a small watercraft hull and engine arrangement. The illustrated embodiments of the hull and engine arrangement are intended merely to illustrate, but not to limit, the invention. The drawings contain eleven figures.

DETAILED DESCRIPTION OF THE PREFERRED EMBODIMENT

With reference to FIGS. 1 through 4, an improved engine and component layout for a watercraft 20 is described below. The engine and component layout efficiently utilizes the available space within a hull of the watercraft 20. The layout also desirably assists in maintaining a low overall center of gravity of the watercraft 20 and provides improved access to components that may require periodic maintenance.

Although the present engine and component layout is illustrated in connection with a personal watercraft, the illustrated layout can be used with other types of watercrafts as well, such as, for example, but without limitation, small jet boats and the like. Alternative embodiments of the present invention will become readily apparent to those of skill in the art from the following detailed description of the preferred embodiments having reference to the attached figures, the invention not being limited to the preferred embodiments disclosed.

Before describing the engine and the component layout of the watercraft 20, an exemplary personal watercraft will first be described in general detail to assist the reader's understanding of the environment of use. The watercraft 20 will be described in reference to a coordinate system wherein a longitudinal axis extends from bow to stem and a lateral axis from port side to starboard side normal to the longitudinal axis. The longitudinal axis lies in a vertical, central plane $C_p$ of the watercraft 20. In addition, relative heights are expressed as elevations in reference to the under surface of the watercraft 20. In various figures, an arrow $F_R$, is used to denote the direction in which the watercraft travels during normal forward operation.

Figure 1:
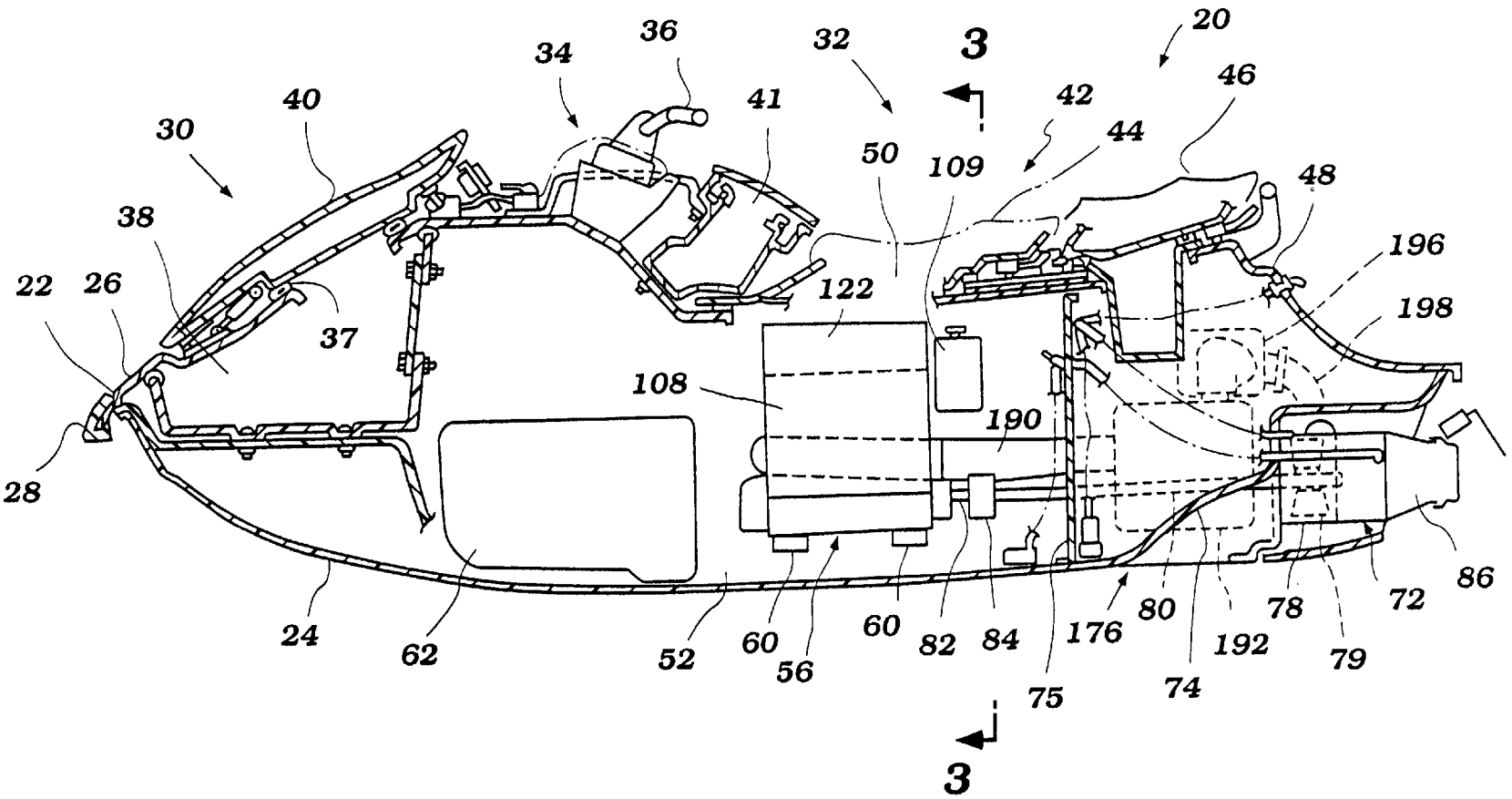
FIG. 1 is a side elevational, partial cross-sectional view of a personal watercraft having a hull and engine arrangement constructed in accordance with a preferred embodiment of the present invention. The hull is shown in cross-section and certain internal components, including the engine, are schematically illustrated.

The watercraft 20 has a hull, indicated generally by the reference numeral 22. The hull 22 can be made of any suitable material, however, a presently preferred construction utilizes molded fiberglass reinforced resin. The hull 22 generally has a lower hull section 24 and an upper deck section 26, as shown in FIG. 1. A bond flange 28 can connect the lower hull section 24 to the upper deck section 26. Of course, any other suitable means may be used to interconnect the lower hull section 24 and the upper deck section 26. Alternatively, the lower hull section 24 and the upper deck section 26 may be integrally formed.

As viewed in the direction from the bow to the stem of the watercraft 20, the upper deck section 26 includes a bow portion 30 and a rider's area 32. Between the bow portion 30 and the rider's area 32, a control mast 34 is provided which supports a handlebar assembly 36. The handlebar assembly 36 controls the steering of the watercraft 20 in a conventional manner. The handlebar assembly 36 may also carry a variety of controls of the watercraft 20, such as, for example, a throttle control, a start switch, and a lanyard switch (not shown).

In the illustrated embodiment, the bow portion 30 of the upper hull section 26 slopes upwardly and an opening 37 is provided through which the rider can access a storage space 38 within the hull 22. A hatch cover 40 is detachably affixed (e.g., hinged) to the bow portion 30 so as to cover the opening 37. Desirably, a cup holder 41 having a hinged lid is provided immediately to the rear of the control mast 34, ahead of the rider's area 32.

Figure 4:
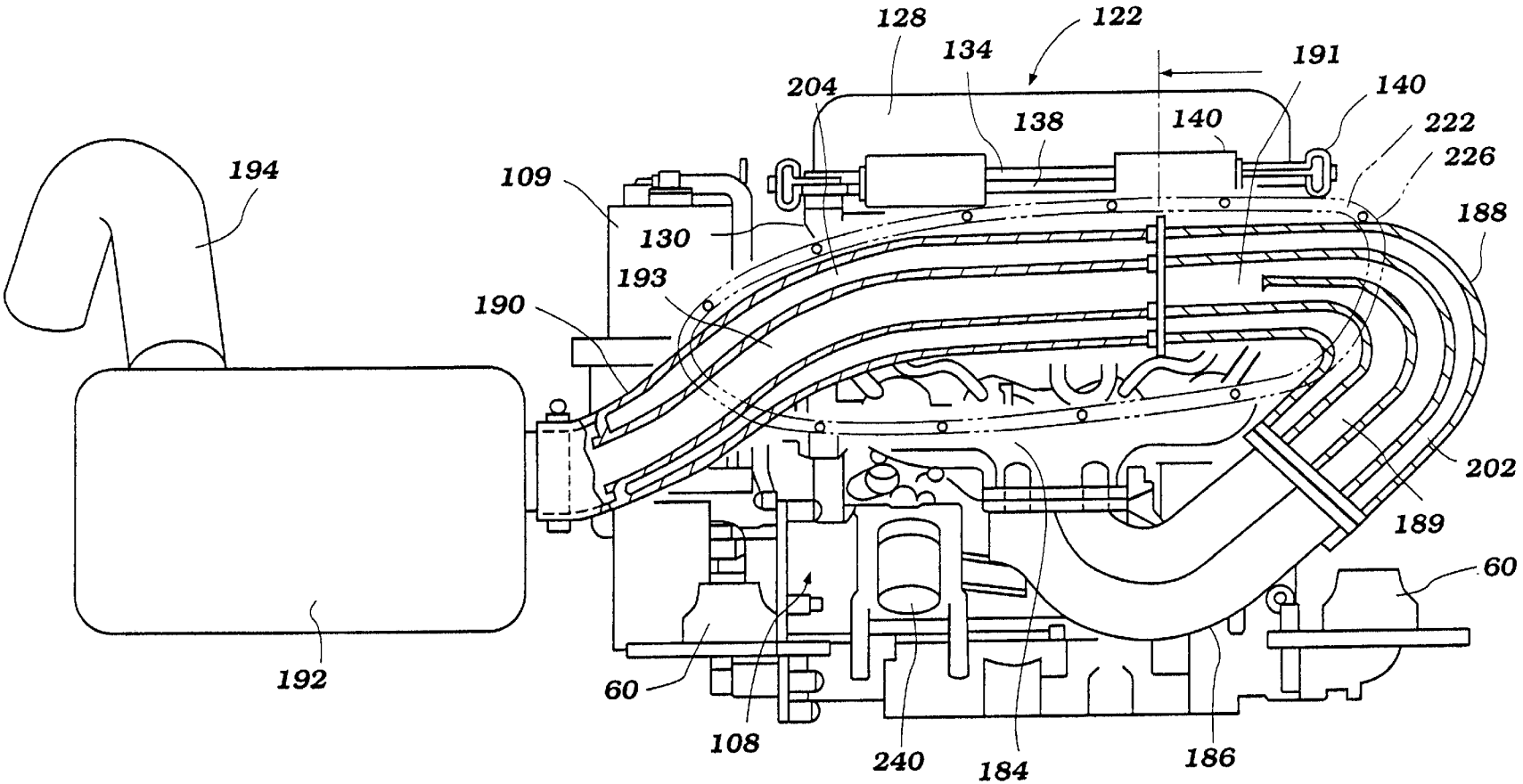
FIG. 4 is a starboard side elevational and partial sectional view of the engine, intake system and exhaust system of the watercraft of FIG. 1.

The rider's area 32 lies behind the control mast 34 and includes a seat assembly 42. The seat assembly 42, at least in part, is formed by at least one seat cushion and, preferably, by forward seat cushion 44 and a rearward seat cushion 46. The seat assembly 42 is supported by a raised pedestal 48 (FIG. 4). The raised pedestal 48 forms a portion of the upper deck 26, and has an elongated shape that extends longitudinally along the center plane $C_P$ of the watercraft 20. The seat cushions 44, 46 are desirably removably attached to a top surface of the raised pedestal 48 by one or more latching mechanisms (not shown) and cover the entire upper end of the pedestal 48 for rider and passenger comfort.

An engine access opening 50 is located in the upper surface of the pedestal 48. The access opening 50 opens into an engine compartment 52 formed within the hull 22. One or both of the seat cushions 44, 46 normally cover and seal the access opening 50. When the seat cushion, or cushions 44, 46 are removed, the engine compartment 52 is accessible through the access opening 50.

Figure 2:
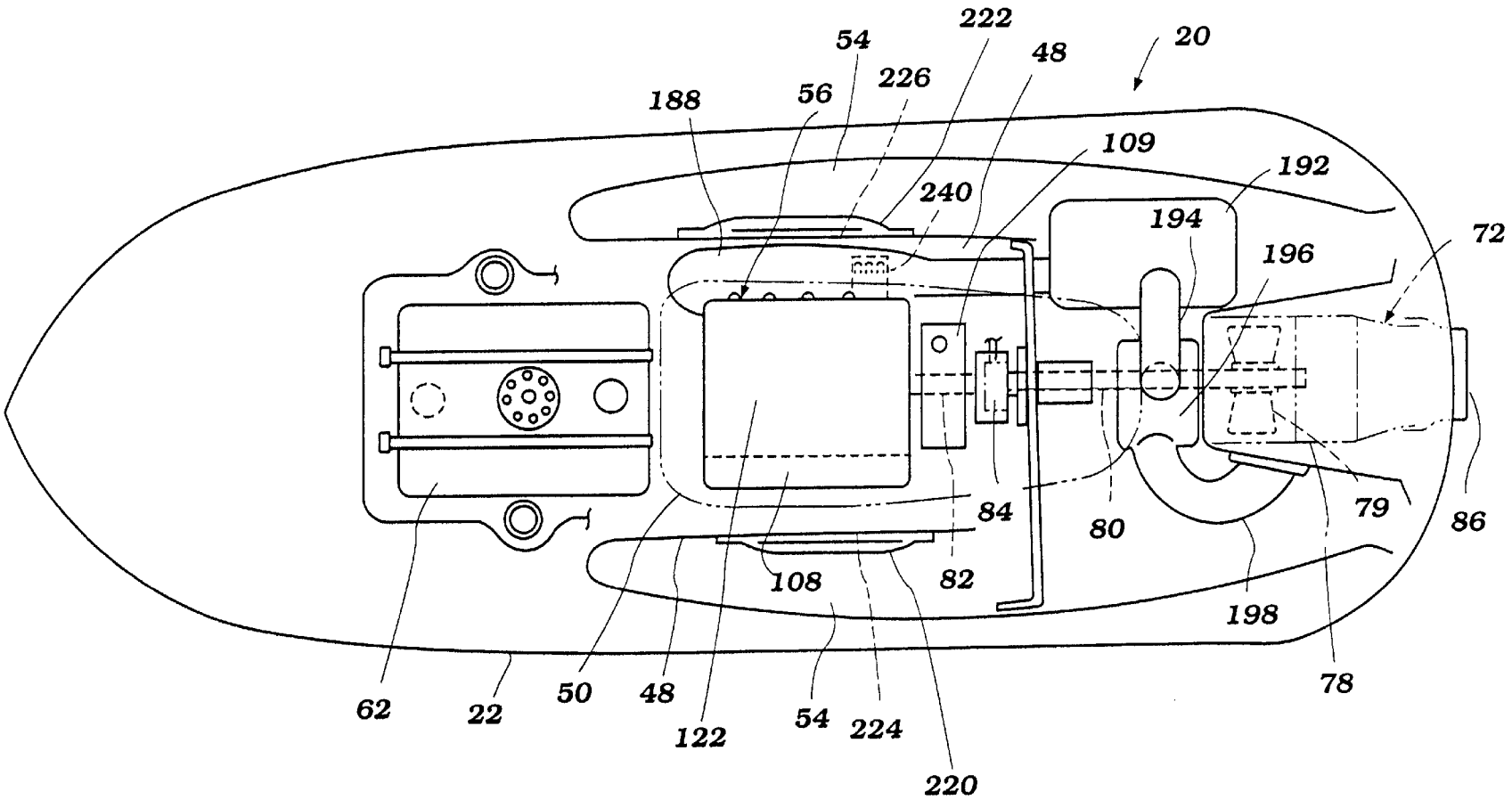
FIG. 2 is a top plan view of the watercraft of FIG. 1.

With reference to FIG. 2, the upper deck portion 26 of the hull 22 advantageously includes a pair of generally planar areas positioned on opposite sides of the seat pedestal 48, which define foot areas 54. The foot areas 54 extend generally along and parallel to the sides of the pedestal 48. In this position, the operator and any passenger seated on the seat assembly 42 can place their feet on the foot areas 54 during normal operation of the watercraft 20. A non-slip (e.g., rubber) mat desirably covers the foot areas 54 to provide increased grip and traction for the operators and passengers.

With reference to both FIGS. 1 and 2, an engine 56 is mounted within the engine compartment 52 in any suitable manner. Preferably, the engine 56 is mounted to a liner 58 (FIG. 4) of the lower hull portion 24 with an assembly of resilient engine mounts 60, as is known in the art. Advantageously, the resilient engine mounts 60 attenuate engine vibrations transmitted to the hull 22 of the watercraft 20.

A fuel tank 62 preferably is arranged forwardly from the engine 56. A fuel filler conduit (not shown) preferably extends between the fuel tank 62 and the upper deck portion 26, and terminates in a fuel filler cap (not shown). Desirably, the fuel filler cap is disposed beneath the hatch cover 40 so that the fuel tank 62 can be opened by opening the hatch cover 40 and removing the filler cap.

The watercraft 20 includes at least one ventilation duct (not shown) and preferably includes a forward ventilation duct and a rearward ventilation duct. The ventilation ducts are configured to guide air into and out of the engine compartment 52. Except for the ventilation ducts, the engine compartment 52 desirably is substantially sealed so as to enclose the engine 56 of the watercraft 20 from the body of water in which the watercraft 20 is operated.

The lower hull section 24 is designed such that the watercraft 20 planes or rides on a minimum surface area at the aft end of the lower hull 24 in order to optimize the speed and handling of the watercraft 20 when up on plane. For this purpose, the lower hull section 24 generally has a V-shaped configuration formed by a pair of inclined sections that extend outwardly from a keel of the hull to the hull's side walls at a dead rise angle. The inclined sections also extend longitudinally from the bow toward the transom of the lower hull 24. The side walls are generally flat and straight near the stem of the hull 24 and smoothly blend towards the longitudinal center plane $C_P$ of the watercraft 20 at the bow 30. The lines of intersection between the inclined sections and the corresponding side walls form the outer chines of the lower hull section 24.

A jet pump unit 72 propels the watercraft 20. The jet pump unit 72 includes a tunnel 74 formed on the under side of the lower hull section 26 which is isolated from the engine compartment by a bulkhead 75. The tunnel 74 has a downward facing inlet port 76 opening toward the body of water. The jet pump housing 78 is disposed within a portion of the tunnel 74 and communicates with the inlet port 76. An impeller 79 is supported within the housing 78.

An impeller shaft 80 extends forwardly from the impeller 79 and is coupled with a crankshaft 82 of the engine 56 by a coupling member 84. The crankshaft 82 of the engine 56 thus drives the impeller shaft 80. Although the impeller shaft 80 is illustrated as a single shaft, it may nonetheless be comprised of two or more shaft portions coupled to one another. Preferably, the impeller shaft 80 includes a first shaft coupled to the impeller 79 and a second shaft connecting the first impeller shaft to the crankshaft 82.

The rear end of the housing 78 defines a discharge nozzle and a steering nozzle 86 is affixed to the discharge nozzle for pivotal movement about a steering axis extending generally vertically. The steering nozzle 86 is connected to the handlebar 36 by a cable so that the rider can pivot the nozzle 86, in a known manner.

As the engine 56 drives the impeller shaft 80 and hence rotates the impeller 79, water is drawn from the surrounding body of water through the inlet port 76. The pressure generated in the housing 78 by the impeller 79 produces a jet of water that is discharged through the steering nozzle 86. This water jet propels the watercraft 20. The rider can move the steering nozzle 86 with the handlebar 36 when he or she desires to turn the watercraft 20 in either direction.

Figure 3:
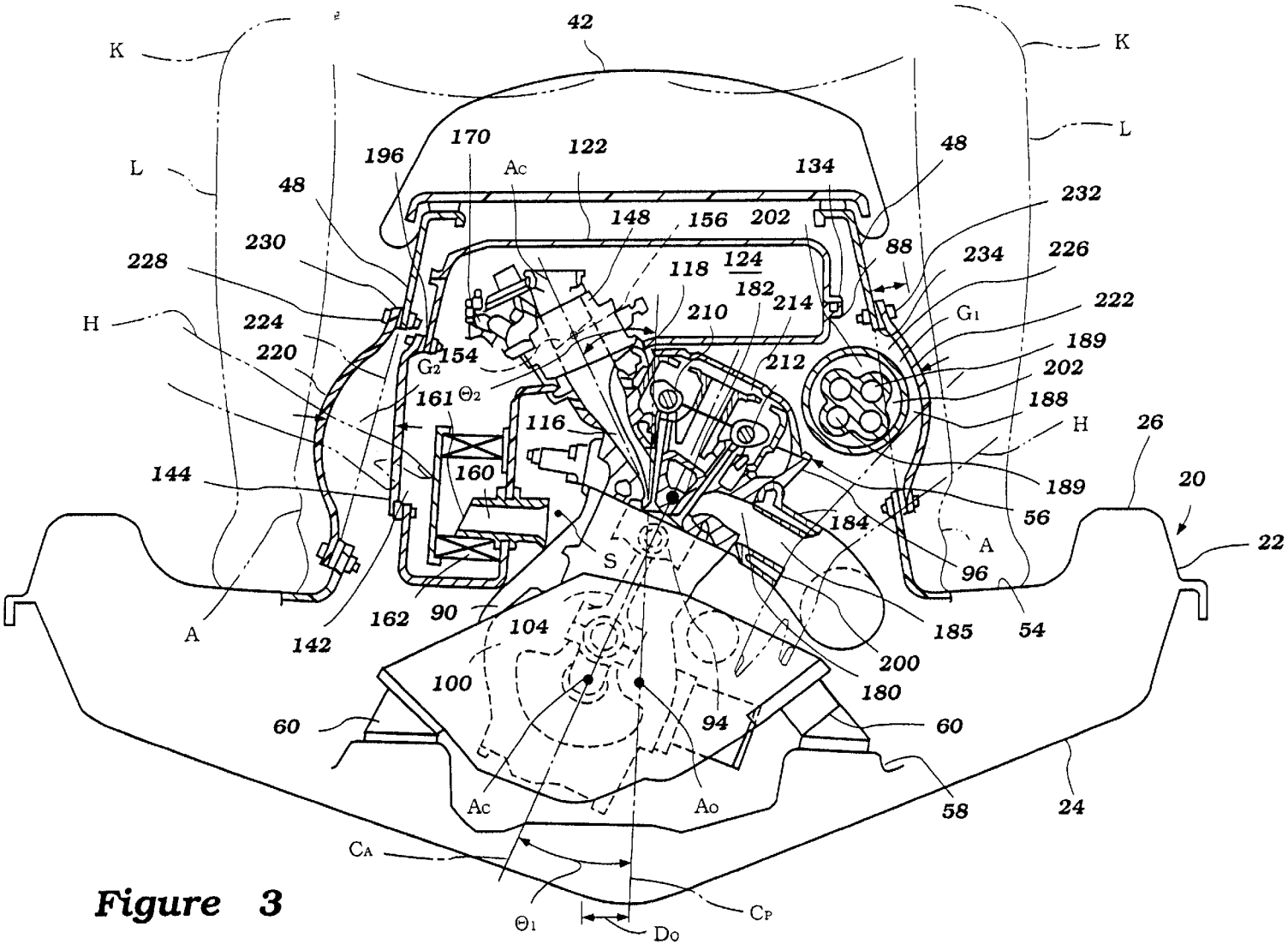
FIG. 3 is a schematic, cross-sectional rear view of the watercraft and the engine. A profile of a hull of the watercraft is shown schematically. The engine, including intake and exhaust systems, and a pedestal portion of the hull are illustrated partially in section. The intake system includes an air intake box defining a plenum chamber and at least one inlet duct defining an inlet opening.

The illustrated engine 56 operates on a four-stroke combustion principle. With reference to FIG. 3, the engine 56 includes a cylinder block 90. The cylinder block 90 defines four cylinder bores (not shown) aligned with each other from fore to aft along the center plane $C_P$. The engine 56 thus is an L4 (in-line four cylinder) type. The illustrated engine, however, merely exemplifies one type of engine with which various aspects and features of the present invention can be used. Engines having other number of cylinders, having other cylinder arrangements, other cylinder orientations (e.g., upright cylinder banks, V-type, and W-type) and operating on other combustion principles (e.g., crankcase compression two-stroke, diesel, and rotary) are all practicable.

Each cylinder bore has a center axis $C_A$ that is canted or inclined at an angle from the center plane $C_P$ so that the engine 56 can be shorter in height. All of the center axes $C_A$ in the illustrated embodiment are inclined at the same angle.

Pistons 94 reciprocate within the cylinder bores. A cylinder head member 96 is affixed to the upper end of the cylinder block 90 to close respective upper ends of the cylinder bores and defines combustion chambers 98, along with the cylinder bores and the pistons 94.

A crankcase member 100 is affixed to the lower end of the cylinder block 90 to close the respective lower ends of the cylinder bores and to define a crankcase chamber. The crankshaft 82 is rotatably connected to the pistons 94 through connecting rods 104 and is journaled for rotation within the crankcase member 100. That is, the connecting rods 104 are rotatably coupled with the pistons 94 and with the crankshaft 82. The crankshaft 82 additionally defines a crankshaft axis $A_C$.

The cylinder block 90, the cylinder head member 96 and the crankcase member 100 together define an engine body 108 (FIG. 1). The engine body 108 preferably is made of an aluminum-based alloy. In the illustrated embodiment, the engine body 108 is oriented in the engine compartment so as to position the crankshaft 82 generally parallel to the central plane $C_P$ and to extend generally in the longitudinal direction. Other orientations of the engine body, of course, are also possible (e.g., with a transverse or vertical oriented crankshaft). As illustrated in FIGS. 1, 2 and 4, a lubricant reservoir 109 is desirably positioned behind the engine body 108. The reservoir 109 supplies lubricant to a lubrication system of the engine 56. The lubrication system may be of any suitable type and, therefore, a detailed description is not deemed necessary to enable one of skill in the art to practice the present invention.

The engine 56 preferably includes an air induction system configured to guide air to the engine body 108 and, thus, to the combustion chambers 98. In the illustrated embodiment, the air induction system includes four air intake ports 116 (one shown) defined in the cylinder head member 96. The intake ports 116 communicate with the associated combustion chambers 98. Intake valves 118 are provided to selectively connect and disconnect the intake ports 116 with the combustion chambers 98. That is, the intake valves 118 selectively open and close the intake ports 116.

The air induction system also includes an air intake box 122 or a "plenum chamber" for smoothing intake air and acting as an intake silencer. The intake box 122 in the illustrated embodiment of FIGS. 1 through 4 is generally L-shaped in cross-section and defines a plenum chamber 124, as described below in greater detail. It is generally desired to make the plenum chamber 124 as large as possible within the space provided in the engine compartment 52 to improve the power output of the engine.

With reference to FIGS. 3 and 4, the intake box 122 comprises an upper chamber member 128 and a lower chamber member 130. The upper and lower chamber members 128, 130 preferably are made of plastic or synthetic resin, although they can be made of metal or other material. While the illustrated intake box 122 is formed by upper and lower chamber members, the intake box 122 can be formed by a different number of members and/or can have a different assembly orientation (e.g., side by side).

The lower chamber member 130 preferably is coupled with the engine body 108. This coupling may be achieved by one or more support members, or stays (not shown), extending from the engine body 108 and being fastened to the intake box 122. The upper and lower chamber members 128, 130 each include a generally horizontally extending flange portion 134, 138, respectively. The flange portion 134 of the upper chamber member 128 abuts the flange portion 138 of the lower chamber member 130. Several coupling or fastening members 140, which are generally configured as a shape of the letter C in section, preferably put both the flange portions 134, 138 therebetween so as to couple the upper chamber member 128 with the lower chamber member 130.

Preferably, four throttle bodies 148 (only one shown) extend through outlet apertures of the intake box 122 and are preferably fixed to the lower chamber member 130. Respective bottom ends of the throttle bodies 148 are coupled with the associated intake ports 116. In the embodiment of FIG. 3, the throttle bodies 148 each define an intake axis $A_I$ which slants toward the port side opposite the center axis $C_A$ of the engine body 108. Respective top ends of the throttle bodies 148 open upwardly within the plenum chamber 124. Air in the plenum chamber 124 thus is drawn to the combustion chambers 98 through the throttle bodies 148 and the intake ports 116 when negative pressure is generated in the combustion chambers 98. The negative pressure is generated when the pistons 94 move toward the bottom dead center from the top dead center position.

As illustrated in FIG. 3, each throttle body 148 includes a throttle valve 154. A throttle valve shaft 156 journaled for pivotal movement, links the entire throttle valve 154. Pivotal movement of the throttle valve shaft 156 is controlled by the throttle lever on the handlebar 36 through a control cable that is connected to the throttle valve shaft 56. The control cable can extend into the intake box 122 through a through-hole (not shown). The rider thus can control an opening amount of the throttle valve 154 by operating the throttle lever to obtain various running conditions of the engine 56 that the rider desires.

Air is introduced into the plenum chamber 124 through a pair of air inlet ports 160 (one shown in FIG. 3). The air inlet port 160 is defined by a duct 161 which is secured within an inlet opening of the air intake box 122. The air inlet port 160 opens, at one end, into an interior space defined by a filter assembly 162. Preferably, the filter assembly 162 is substantially rectangular in shape and arranged such that air entering the intake port 160 must travel through the filter assembly 162 before reaching the throttle bodies 148. Desirably, the filter assembly 162 includes both an oil-resistant element and a water-repellent element.

With reference to FIGS. 1 through 3, the engine 56 also includes a fuel supply system configured to supply fuel to the engine body 108 for combustion therein. The fuel supply system includes the fuel tank 62 and fuel injectors 170 that are mounted on the throttle bodies 148. Preferably, one fuel injector 170 is associated with each throttle body 148 and all of the fuel injectors 170 are interconnected by a fuel rail. Because the throttle bodies 148 are disposed within the plenum chamber 124, the fuel injectors 170 are also desirably positioned within the plenum chamber 124. However, other types of fuel injectors can be used which are not mounted in the intake box 122, such as, for example, but without limitation, direct fuel injectors and induction passage fuel injectors connected to the scavenge passages of two-cycle engines. Electrical cables for the fuel injectors 170 preferably enter the intake box 122 through the same through-hole with the control cable of the throttle shaft 156. Each fuel injector 170 has an injection nozzle directed toward the intake port 116 associated with each fuel injector 170.

Desirably, the fuel supply system also includes a low pressure fuel pump, a vapor separator, a high pressure fuel pump and a pressure regulator, in addition to the fuel tank 62 and the fuel injectors 170. Fuel supplied from the fuel tank 62 is pressurized by the low pressure fuel pump and is delivered to the vapor separator wherein the fuel is separated from fuel vapors. One or more high pressure fuel pumps draw the fuel from the vapor separator and pressurize the fuel before it is delivered to the fuel injectors 170. The pressure regulator controls the pressure to supply the fuel, i.e., limits the fuel pressure to a pre-set pressure level.

The fuel injectors 170 spray the fuel into the intake ports 116 at an injection timing and duration under control of an ECU (electronic control unit). The ECU can control the injection timing and duration according to any known control strategy which preferably refers to a signal from at least one engine sensor, such as, for example, but without limitation, a throttle valve position sensor. The sprayed fuel is delivered to the combustion chambers 98 with the air when the intake ports 116 are opened to the combustion chambers 98 by the intake valves 118. The air and the fuel are mixed together to form air fuel charges which are then combusted in the combustion chambers 98.

The engine 56 further includes a firing or ignition system. Desirably, a spark plug (not shown) is affixed to the cylinder head member 96 for each of the four combustion chambers 98. The spark plugs are arranged so that electrodes which are defined at one end of the plugs are exposed to the respective combustion chambers 98. Plug caps are detachably coupled with the other ends of the spark plugs and have electrical connection with the plugs. Electric power is supplied to the plugs through power cables and the plug caps. The spark plugs are fired at an ignition timing under control of the ECU. The air fuel charges are combusted during every combustion stroke accordingly.

The engine 56 further includes an exhaust system to discharge burnt charges, i.e., exhaust gases, from the combustion chambers 98. Preferably, the exhaust system includes four exhaust ports 180 (only one shown). The exhaust ports 180 are defined in the cylinder head member 96 and communicate with the associated combustion chamber 98. Exhaust valves 182 are provided to selectively connect and disconnect the exhaust ports 180 with the combustion chambers 98. That is, the exhaust valves 182 selectively open and close the exhaust ports 180.

As illustrated in FIGS. 3 and 4, the exhaust system also includes an exhaust manifold 184, which defines four passages 185 (one shown), each communicating with one of the exhaust ports 180. In a presently preferred embodiment, the manifold 184 comprises a first exhaust manifold connected with two of the exhaust ports 180 and a second exhaust manifold connected with the other two exhaust ports 180. Preferably, the first and second exhaust manifolds are configured to nest with each other. A downstream end of the exhaust manifold(s) 184 is coupled with a first unitary exhaust conduit 186. The passages 185 of the manifold 184 communicate with four passages (not shown) defined by the first unitary conduit 186.

As illustrated in FIG. 4, the first unitary conduit 186 is further coupled with a second unitary exhaust conduit 188. The four passages of the first unitary exhaust conduit communicate with four passages 189 of the second unitary exhaust conduit 188. The four passages 189 converge into a single passage 191 toward a downstream end of the second unitary exhaust conduit 188.

The second unitary exhaust conduit 188 is then coupled with an exhaust pipe 190 on the rear side of the engine body 108. The single passage 191 of the second unitary exhaust conduit 188 communicates with a single passage 193 of the exhaust pipe 190. The exhaust pipe 190 is then connected to a water lock 192 at a forward surface of the water lock 192.

With additional reference to FIGS. 1 and 2, a discharge pipe 194 extends from a top surface of the water lock 192 and transversely across the center plane $C_P$. The discharge pipe 194 may then open through the hole 22 or, optionally, the discharge pipe 194 may open into a silencer box 196, as illustrated. The silencer box 196 reduces the noise caused by exhaust gases being discharged from the exhaust system. A second discharge pipe 198 extends rearwardly from the silencer box 196 and opens at a stem of the lower hull section 24 in a submerged position. The water lock 192 advantageously inhibits the water in the discharge pipe 194, silencer box 196, or second discharge pipe 198 from entering the exhaust pipe 190, as is known in the art.

The engine 56 further includes a cooling system configured to circulate coolant into thermal communication with at least one component within the watercraft 20. Preferably, the cooling system is an open-type cooling system, circulating water from the body of water in which the watercraft 20 is operating, into thermal communication with heat-generating components within the watercraft 20. However, other types of cooling systems can be used, such as, for example, but without limitation, closed type liquid cooling systems using lubricated coolants and air-cooling types.

The cooling system includes a water pump arranged to introduce water from the body of water surrounding the watercraft 20, and a plurality of water jackets defined, for example, in the cylinder block 90 and the cylinder head member 96. The jet propulsion unit 72 preferably is used as the water pump with a portion of the water pressurized by the impeller 79 being drawn off for the cooling system, as is known in the art. Although the water is primarily used for cooling these engine portions, part of the water is used also for cooling the exhaust system. That is, the engine 56 has at least an engine cooling system and an exhaust cooling system. The water directed to the exhaust cooling system preferably passes through a separate channel apart from the channel connected to the engine cooling system.

Desirably, at least a portion of the previously described exhaust components are formed as dual passage structures including a water jacket. Specifically, with reference to FIG. 3, a water jacket 200 is formed by the exhaust manifold 184 and is in thermal communication with the exhaust passage 180. With reference to FIG. 4, the second unitary conduit defines a water jacket 202 which communicates with the water jacket 200 of the manifold 184 and further communicates with a water jacket (not shown) of the first unitary conduit 186. Additionally, the water jacket 202 of the second unitary exhaust conduit 188 communicates with a water jacket 204 defined by the exhaust pipe 190.

With reference to FIG. 3, the engine 56 has a valve-cam mechanism for actuating the intake and exhaust valves 118, 182. In the illustrated embodiment, a double overhead camshaft drive is employed. That is, an intake camshaft 210 actuates the intake valves 118 and an exhaust camshaft 212 separately actuates the exhaust valves 182. The intake camshaft 210 extends generally horizontally over the intake valves 118 from fore to aft and parallel to the center plane $C_P$, and the exhaust camshaft 212 extends generally horizontally over the exhaust valves 182 from fore to aft also in parallel to the center plane $C_P$.

Both the intake and exhaust camshafts 210, 212 are journaled by the cylinder head member 96 with a plurality of camshaft caps. The camshaft caps holding the camshafts 210, 212 are affixed to the cylinder head member 96. A cylinder head cover member 214 extends over the camshafts 210, 212, and the camshaft caps, and is affixed to the cylinder head member 96 to define a camshaft chamber.

The intake camshaft 210 has cam lobes each associated with a respective intake valve 118, and the exhaust camshaft 212 also has cam lobes associated with respective exhaust valve 182. The intake and exhaust valves 118, 182 normally close the intake and exhaust ports 116, 180 by a biasing force of springs (not shown). When the intake and exhaust camshafts 210, 212 rotate, the cam lobes push the respective valves 118, 182 to open the respective ports 116, 180 by overcoming the biasing force of the spring. The air thus can enter the combustion chambers 98 when the intake valves 118 open. In a similar manner, the exhaust gases can move out from the combustion chambers 98 when the exhaust valves 182 open.

The crankshaft 82 preferably drives the intake and exhaust camshafts 210, 212. The respective camshafts 210, 212 have driven sprockets affixed to the ends thereof. The crankshaft 82 has a drive sprocket affixed to the end thereof. Each driven sprocket has a diameter which is twice as large as a diameter of the drive sprocket. A timing chain or belt is wound around the drive and driven sprockets. When the crankshaft 82 rotates, the drive sprocket drives the driven sprockets via the timing chain, and thus the intake and exhaust camshafts 210, 212 also rotate. The rotational speed of the camshafts 210, 212 are reduced to half as the rotational speed of the crankshaft 82 because of the differences in diameters of the drive and driven sprockets.

In operation, ambient air enters the internal cavity 52 defined in the hull 22 through the ventilation ducts and is introduced into the plenum chamber 124 defined by the intake box 122 through the air inlet port 160 and is drawn into the throttle bodies 148. The air filter assembly 162 filters the air. The throttle valves 154 and the throttle bodies 148 regulate an amount of air permitted to pass through the combustion chambers 98. The opening angles of the throttle valves 154 are controlled by the rider with a throttle lever mounted to the handlebar 36 and thus controls the air flow across the valves. The air hence flows into the combustion chamber 98 when the intake valves 118 open. At the same time, the fuel injectors 170 spray fuel into the intake ports 116 under the control of the ECU. Air/fuel charges are thus formed and delivered to the combustion chambers 98.

The air/fuel charges are fired by the spark plugs under the control of the ECU. The burnt charges, i.e., exhaust gases, are discharged to the body of water surrounding the watercraft 20 through the exhaust system. The combustion of the air-fueled charges causes the pistons 94 to reciprocate and thus causes the crankshaft 82 to rotate. The crankshaft 82 drives the impeller shaft 80 and the impeller 79 rotates in the hull tunnel 74. Water is thus drawn into the tunnel 74 through the inlet port 76 and then is discharged rearwardly through the steering nozzle 86. The rider steers the nozzle 86 by steering the handlebar 36. The watercraft 20 thus moves as the rider desires.

With reference to FIG. 3, a preferred engine layout will be described in detail. As mentioned above, the cylinder axis $C_A$ of the engine 56 is canted, or inclined relative to the central plane $C_P$ of the watercraft 20. Thus, an angle θ1 is defined between the central plane $C_P$ and the cylinder axis $C_A$. Canting the engine 56 in such a manner advantageously reduces the vertical height of the engine 56 thereby lowering the center of gravity of the watercraft 20.

Desirably, the engine 56 is positioned such that the crankshaft axis $A_C$ is horizontally offset from an axis $A_O$ of the impeller shaft 80, thus defining a horizontal offset distance $D_O$. However, preferably, the axis $A_C$ of the crankshaft 82 and the axis $A_O$ of the impeller shaft 80 are at approximately the same vertical position.

Additionally, the intake axis $A_I$ is inclined, or canted, from the central plane $C_P$ of the watercraft 20. Thus, an angle θ2 is defined between the center plane $C_P$ and the intake axis $A_I$. Canting the intake axis $A_I$ also serves to lower the vertical height of the engine 56. Desirably, the angle θ2 is less than or equal to 60°, thereby reducing the flow resistance of the intake air travelling through the throttle body 148. In this manner, a diameter of the throttle body 148 may remain relatively small while still ensuring adequate intake air flow.

Desirably, the exhaust manifold 184 and the conduit portion of the exhaust system (i.e., first and second unitary exhaust conduits 186, 188 and exhaust pipe 190) are positioned on one side of the central plane $C_P$. Preferably, these components are positioned on the side of the central plane $C_P$ toward which the engine body 108 is canted. In the illustrated embodiment, the engine body 108 is canted toward the starboard side of the watercraft 20 and thus the exhaust manifold 14 and the exhaust conduit portion are positioned on the starboard side of the central plane $C_P$. Such an arrangement efficiently utilizes available space within the engine compartment 52 and permits a large plenum chamber 124 to be employed, as described below.

The first unitary exhaust conduit 186 extends in a downward direction from the exhaust manifold 184 before curving in an upward direction and meeting with the second unitary exhaust conduit 188. The second unitary exhaust conduit 188 extends from the downstream end of the first unitary conduit 186 in an upward direction before curving rearwardly into a generally horizontal portion. The downstream end of the second unitary exhaust 188 is positioned proximate the cylinder head member 96 and is connected to an upstream end of the exhaust pipe 190. The exhaust pipe 190 extends in a rearward direction substantially horizontally before curving downward and being coupled to the water lock 192.

As mentioned above, the illustrated engine arrangement provides ample room for a large plenum chamber 124 to be employed. At least a portion of the plenum chamber 124 is desirably positioned on a side of the center plane $C_P$ opposite the conduit portion of the exhaust system and, thus, to the opposite side from which the engine body 108 is canted. The inclined orientation of the engine body 108 provides a relatively large space on the side opposite from which the engine body 108 is canted.

The plenum chamber 124 includes a vertical portion which extends from a position proximate the crankcase 90 in an upward direction towards a position proximate the cylinder head member 96 on the port side of the central plane $C_P$. In the illustrated embodiment, the plenum chamber 124 also includes a substantially horizontal portion which extends from the upper end of the vertical portion toward the starboard side of the watercraft 20 and preferably extends at least past the central plane $C_P$. Thus, the plenum chamber 124 assumes an L-shape in cross section and has a relatively large volume. Advantageously, the large volume plenum chamber 124 provides improved intake air silencing and increased power output of the engine.

Advantageously, the inlet port 160 opens, at its exposed end, within a space S defined between the air intake box 122 and the engine body 108. The crankcase member 100 of the engine body 108 is positioned below the inlet port 160 and a portion of the air intake box 122 is positioned above the inlet port 160. With such an arrangement, the presence of the intake box 122 and engine body 108 inhibits water which may be splashing within the engine compartment 52 from entering the plenum chamber 124. Desirably, the engine body 108 and the air intake box 122 are positioned very closely to one another at a lower portion of the air intake box 122 below the inlet port 160. This arrangement inhibits water from entering the space S from below. Additionally, the horizontal portion of the air intake box 122 advantageously extends over the upper end of the space S to inhibit water from entering from above the space S.

With reference to FIGS. 2–4, the hull 22 of the illustrated watercraft 20 includes a pair of removable covers, including a port-side cover 220 and a starboard side cover 222. The covers 220, 222 are sized in shape to cover respective openings 224, 226 defined by the pedestal 48 of the upper deck portion 26 of the hull 22. Each of the covers 220, 222 are desirably curved outwardly from the surface of the pedestal 48 thereby increasing the volume of the engine compartment 52. Additionally, the outwardly curved portions of the covers 220, 222 are vertically positioned with respect to the foot areas 54 and the seat assembly 42 so as to not come in contact with the ankles A or knees K of the rider's legs L.

The port-side cover 220 is removably attached to the watercraft hull 22 by a plurality of threaded fasteners, or bolts 228. Desirably, a seal member 230 is positioned between the cover 220 and the pedestal 48 portion of the hull 22 to inhibit water from entering the engine compartment 52. Similarly, the starboard side cover 222 is attached to the hull 22 by a plurality of threaded fasteners or bolts 232. Desirably, a seal member 234 is also positioned between the cover 222 and the pedestal portion 48 of the watercraft hull 22.

With reference to FIG. 4, the relative size, shape, and position with respect to the engine 56 of the starboard side opening 226 is illustrated in the phantom. As illustrated, the opening 226 preferably extends at least the length of the engine body 108. In addition, the opening 226 is positioned vertically such that it is substantially aligned with the horizontal portion of the exhaust conduits 188, 190. The opening 226 permits the exhaust system to be accessed and desirably removable through the opening 226 of the hull 22. In addition, other components of the engine 56, such as an oil filter 240, are desirably accessible through the opening 226, as illustrated by the person's arm and hand H shown in phantom in FIG. 3.

As mentioned above, the outward curve of the covers 220, 224 increases the volume of the engine compartment 52. Preferably, at least a portion of one, or both, of the second unitary exhaust conduit 188 and exhaust pipe 190 protrudes through a plane defined by the opening 226, as illustrated in FIG. 3. Thus, the cross section of the exhaust pipe 190 may be enlarged to improve power of the engine 56 without increasing the width of the pedestal portion 48 of the hull 22.

Advantageously, the port side cover 220 is removable to permit access to the intake airbox 122. The side surface of the lower chamber member 130 of the air intake box 122 desirably defines an opening 142 sized in shape to permit passage of the air filter assembly 162 therethrough. The opening 142 is desirably closed by a cover 144 which is removably attached to the lower chamber member 130 by a plurality of bolts 146. If desired, a seal member may be positioned between the cover 144 and the lower chamber member 130 to inhibit water from entering the plenum chamber 124. Advantageously, the cover 220 may be removed exposing the cover 144 of the air intake box 122. The cover 144 may be removed from the air intake box 122 thereby permitting access to the filter assembly 162 for servicing. Desirably, the cover 220 is spaced from the air intake box 122 defining a gap G2 therebetween. The gap G2 is desirably of a distance sufficient to substantially prevent engine vibrations from being transmitted to the hull 22.

Figure 5:
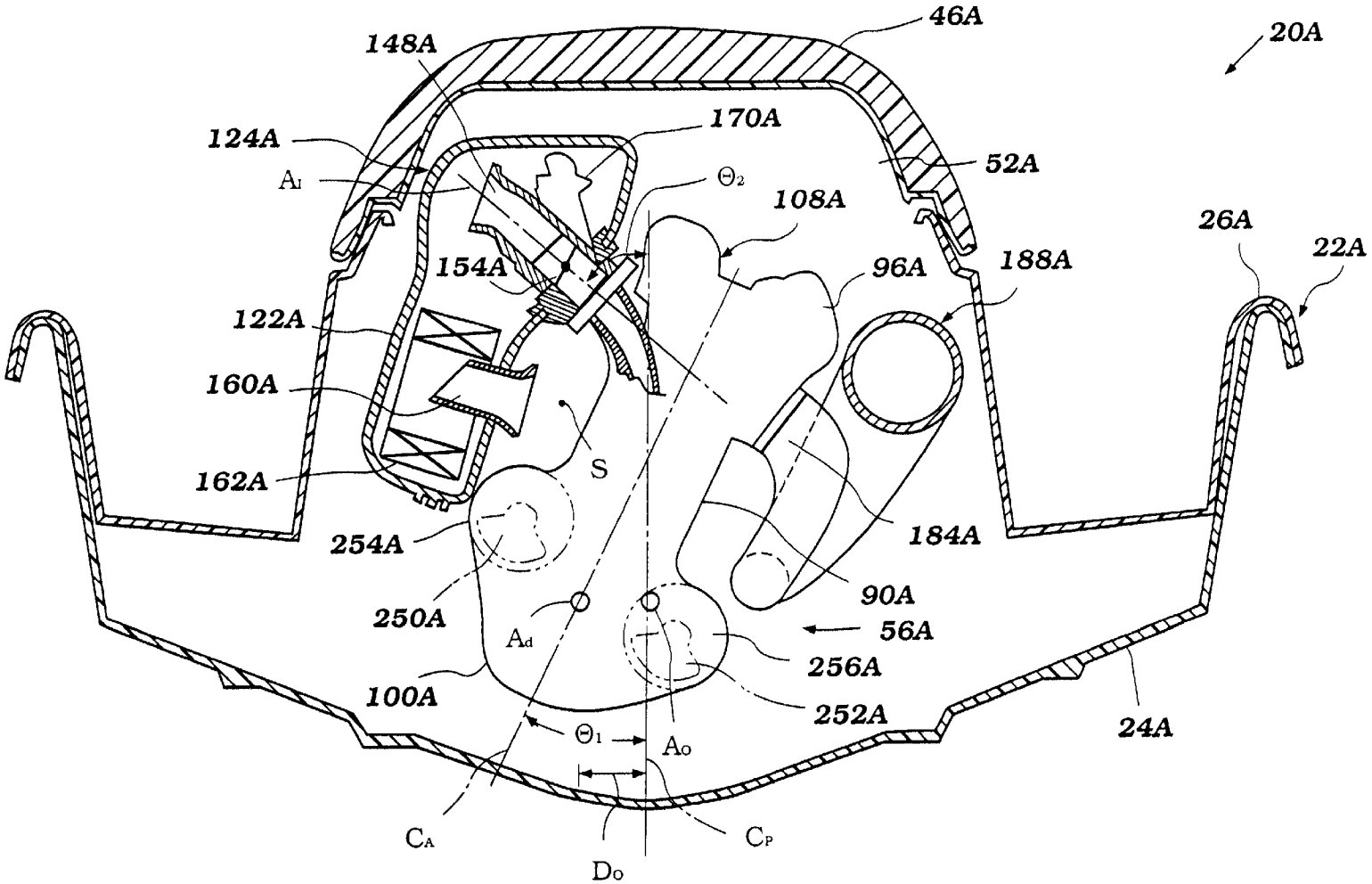
FIG. 5 is a schematic, cross-sectional rear view of a modification of the watercraft shown in FIG. 3. An intake system, an exhaust system, and the hull are illustrated partially in section.

With reference to FIG. 5, a modification of the watercraft 20 shown in FIG. 3 is illustrated and is generally referred to with the reference numeral 20A. Similarly, like components to the watercraft 20 of FIG. 3 will be referred to with like reference numerals, except that an "A" will be added.

In this embodiment, the cylinder axis $C_A$ is also inclined with respect to the central plane $C_P$ such that the engine body 108A is canted toward the starboard side of the watercraft 20A. The exhaust manifold 184A and conduits 186A, 188A, 190A are disposed on the side of the central plane $C_P$ towards which the engine body 108A is canted. In addition, the intake axis $A_I$ is also inclined with respect to the central plane $C_P$. However, in the embodiment of FIG. 5, the air intake box 122A extends substantially vertically on the port side of the engine body 108A and does not extend across the central plane $C_P$, unlike the air intake box 122 (FIG. 3).

Additionally, the engine 56A includes a pair of balance shafts 250A, 252A, illustrated schematically. As is known, the balance shafts 250A, 252A are driven by the crankshaft 82A and include balancing weight portions to counteract the rotating mass of the engine (e.g., the pistons and connecting rods) to smooth the operation of the engine 56A and cancel undesirable vibration.

The crankcase member 100A includes protruding portions 254A, 256A to accommodate the balance shafts 250A, 252A. The protruding portion 254A advantageously is positioned very close to a lower end of the air intake box 122A to inhibit water within the engine compartment 52A from entering the space S from below, as described above in relation to the watercraft 20 of FIGS. 1–4.

Figure 6:
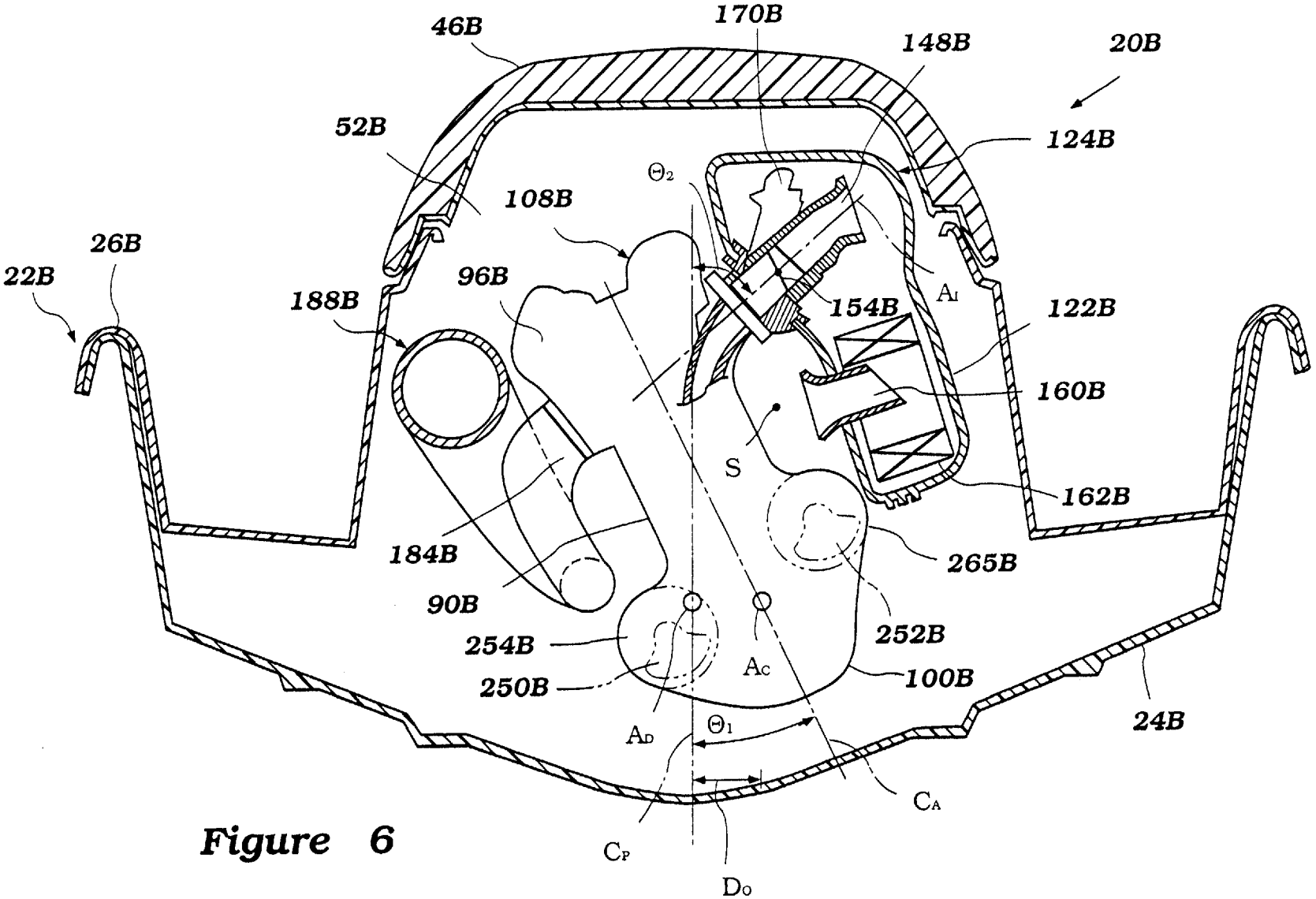
FIG. 6 is a schematic, cross-sectional rear view of a modification of the watercraft shown in FIG. 5, wherein the engine is inclined toward a port side of the watercraft. The intake system, the exhaust system, and the hull are illustrated partially in section.

FIG. 6 illustrates a modification of the watercraft 20A shown in FIG. 5, and is generally referred to with the reference numeral 20B. In addition, like components to the watercraft 20A of FIG. 5 will be referred to with like reference numerals, except that a "B" will be added.

The engine body 108B of the is canted towards the port side of the watercraft 20B and the placement of the exhaust manifold 184B and exhaust conduits 186B, 188B, 190B and the air intake box 122B have been transposed from the watercraft 20A of FIG. 5. Thus, the exhaust manifold 184B and conduits 186B, 188B, 190B are disposed on the port side of the central plane $C_P$ and the intake box 122B is disposed on the starboard side of the central plane $C_P$. In a similar manner to the watercraft 20A of FIG. 5, the protruding portion 256B cooperates with a lower end of the air intake box 122B to inhibit water from entering the space S.

Figure 7:
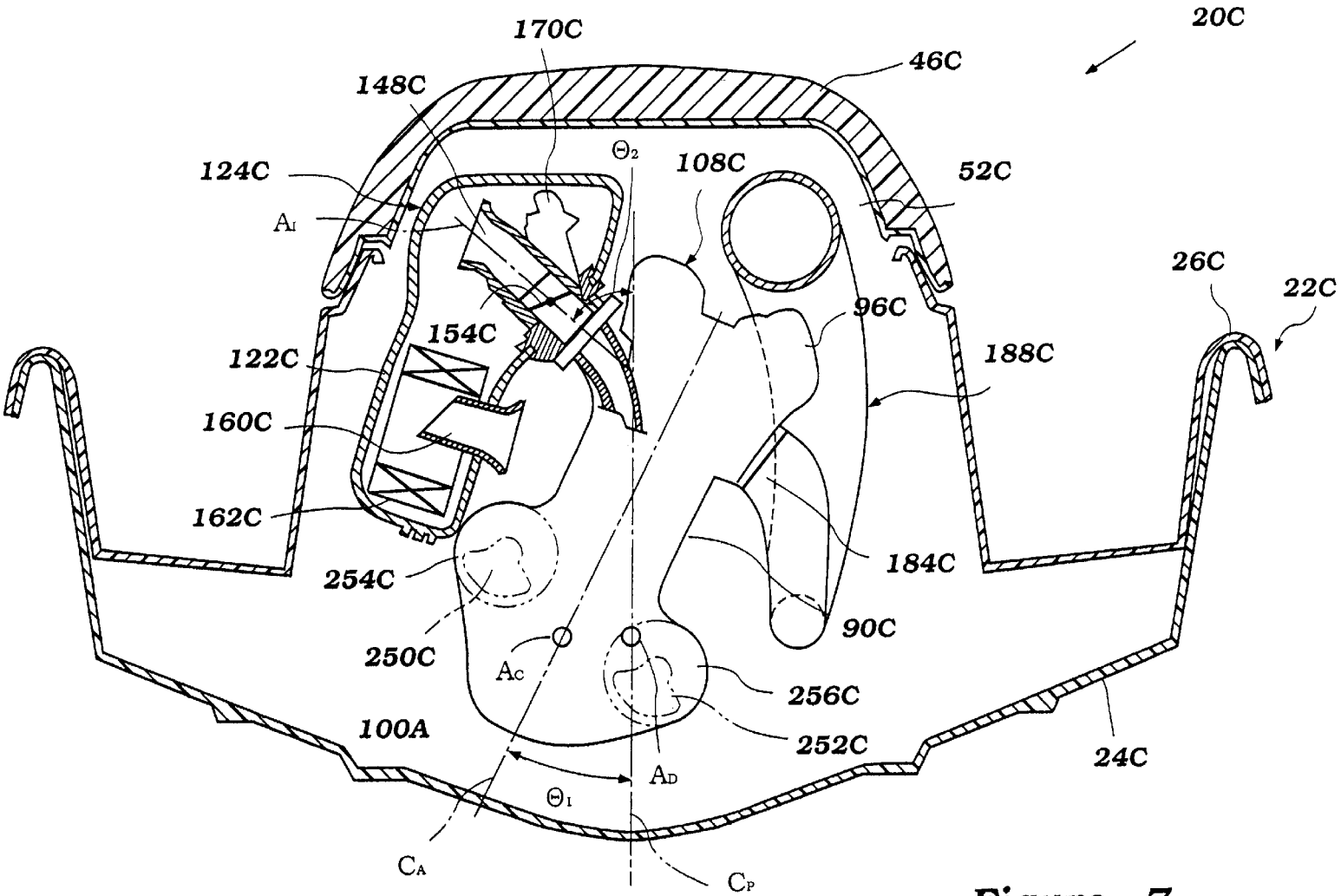
FIG. 7 is a schematic, cross-sectional rear view of a further modification of the watercraft shown in FIG. 5, wherein the engine is inclined toward a starboard side of the watercraft. An intake system, an exhaust system, and the hull are illustrated partially in section. A portion of an exhaust conduit of the exhaust system passes substantially longitudinally above the engine.

With reference to FIG. 7, a modification of the watercraft 20A of FIG. 5 is illustrated and is generally referred to with the reference numeral 20C. Like components to the watercraft 20A of FIG. 5 will be referred to with like reference numerals, except that a "C" will be added.

The engine body 108C is again canted towards the starboard side of the watercraft 20C with respect to the central plane $C_P$. The air intake box 122C extends vertically along the side of the engine body 108C on the portside of the watercraft 20C. However, the exhaust conduits 188C, 190C are arranged such that the horizontal portions of the second unitary exhaust conduit 188C and the exhaust pipe 190C extend rearwardly above the cylinder head member 96C of the engine body 108C. Preferably, the horizontal portion of the exhaust conduit 188C, 190C intersect the cylinder axis $C_A$. This arrangement decreases the lateral width of the engine 56C and maximizes the utilization of the space above the engine body 108C.

Figure 8:
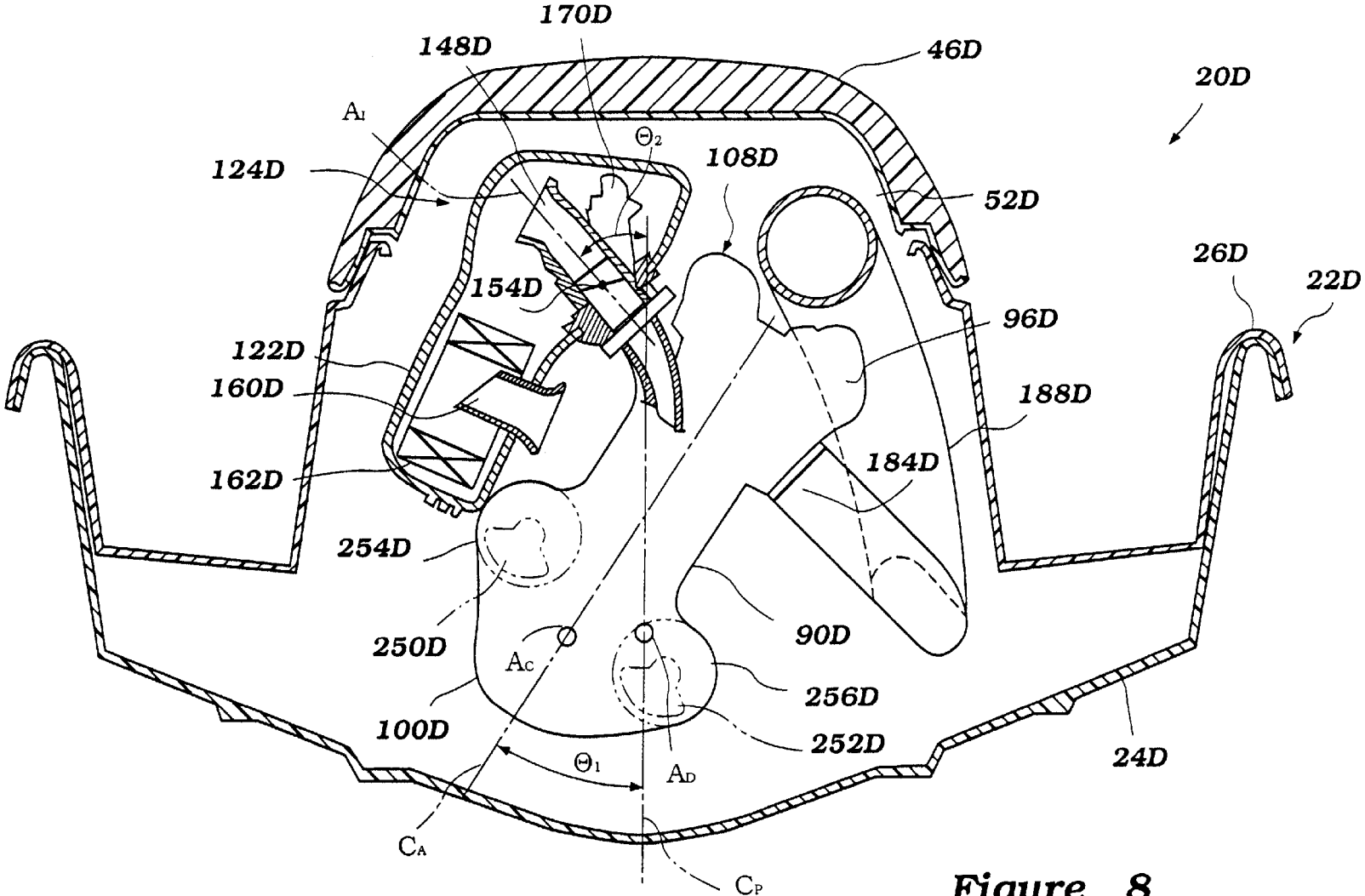
FIG. 8 is a schematic, cross-sectional rear view of a yet another modification of the watercraft shown in FIG. 7, wherein an exhaust manifold portion of the exhaust system extends substantially perpendicular to the engine. The intake system, the exhaust system, and the hull are illustrated partially in section.

With reference to FIG. 8, a modification of the watercraft 20C of FIG. 7 is illustrated and is generally referred to with the reference numeral 20D. Like components to the watercraft 20C of FIG. 7 will be referred to with like reference numerals, except that a "D" will be added.

In the watercraft 20D of FIG. 8, the exhaust manifold 184D and first unitary exhaust conduit 186D extend laterally from the engine body 108D rather than in a substantially downward direction as in the previous embodiments. Such an arrangement utilizes lateral space available beside the engine body 108D to allow the exhaust manifold 184D to follow a more linear path as it extends from the engine body 108D.

Figure 9:
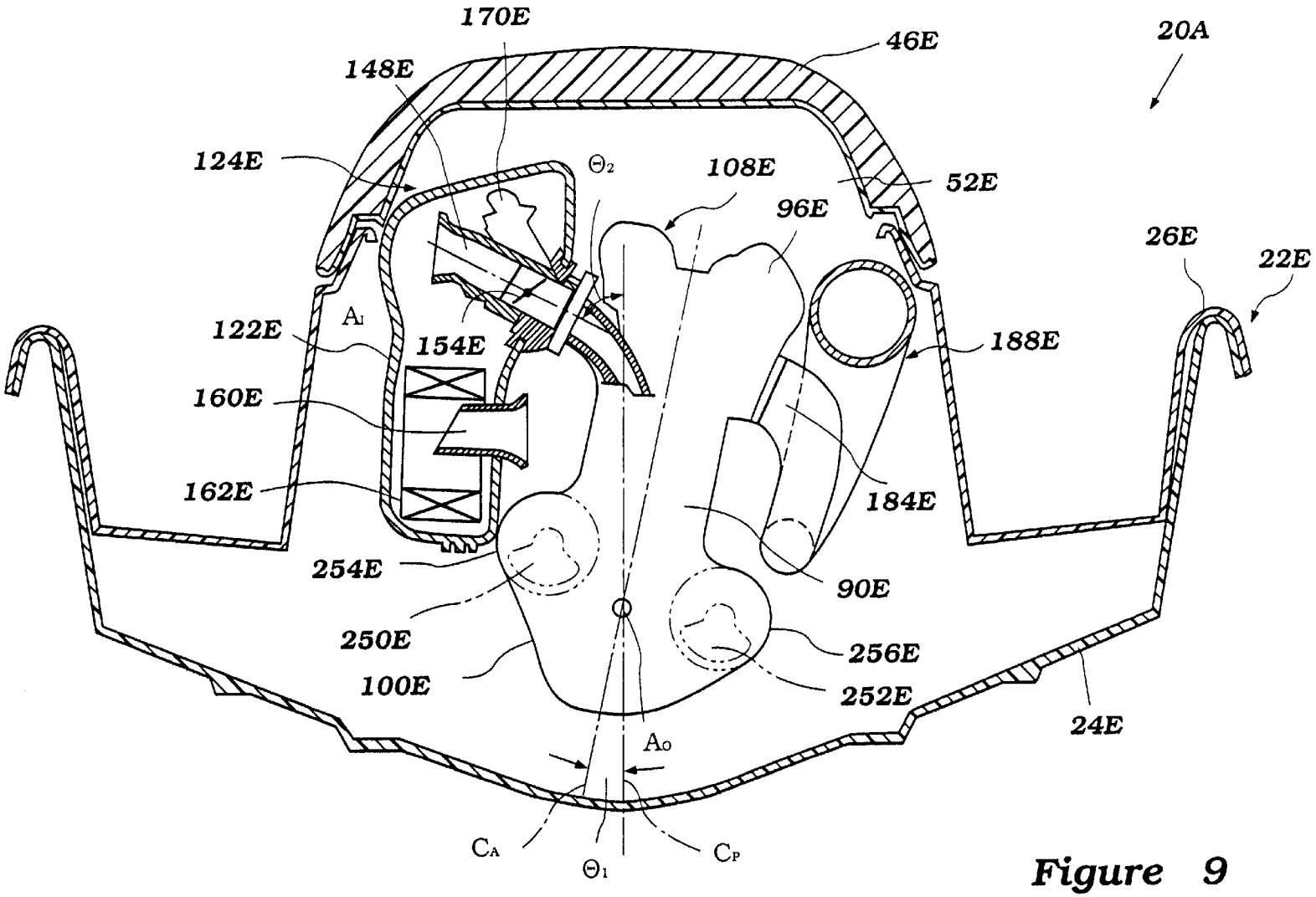
FIG. 9 is a schematic, cross-sectional rear view of an additional modification of the watercraft shown in FIG. 5, wherein the engine is inclined toward a starboard side of the watercraft. An intake system, an exhaust system, and the hull are illustrated partially in section. A crankshaft of the engine is aligned coaxially with an output shaft of the watercraft.

With reference to FIG. 9, a modification of the watercraft 20A of FIG. 5 is illustrated and is generally referred to with the reference numeral 20E. Like components to the watercraft 20A of FIG. 5 will be referred to with like reference numerals, except that an "E" will be added.

The engine body 108E is again canted such that an angle θ1 is defined between the cylinder axis $C_A$ and the central plane $C_P$. However, the crankshaft axis $A_C$ overlaps an axis $A_O$ defined by the output shaft 80 (FIG. 1), rather than being laterally displaced therefrom as in the watercrafts described above.

Figure 10:
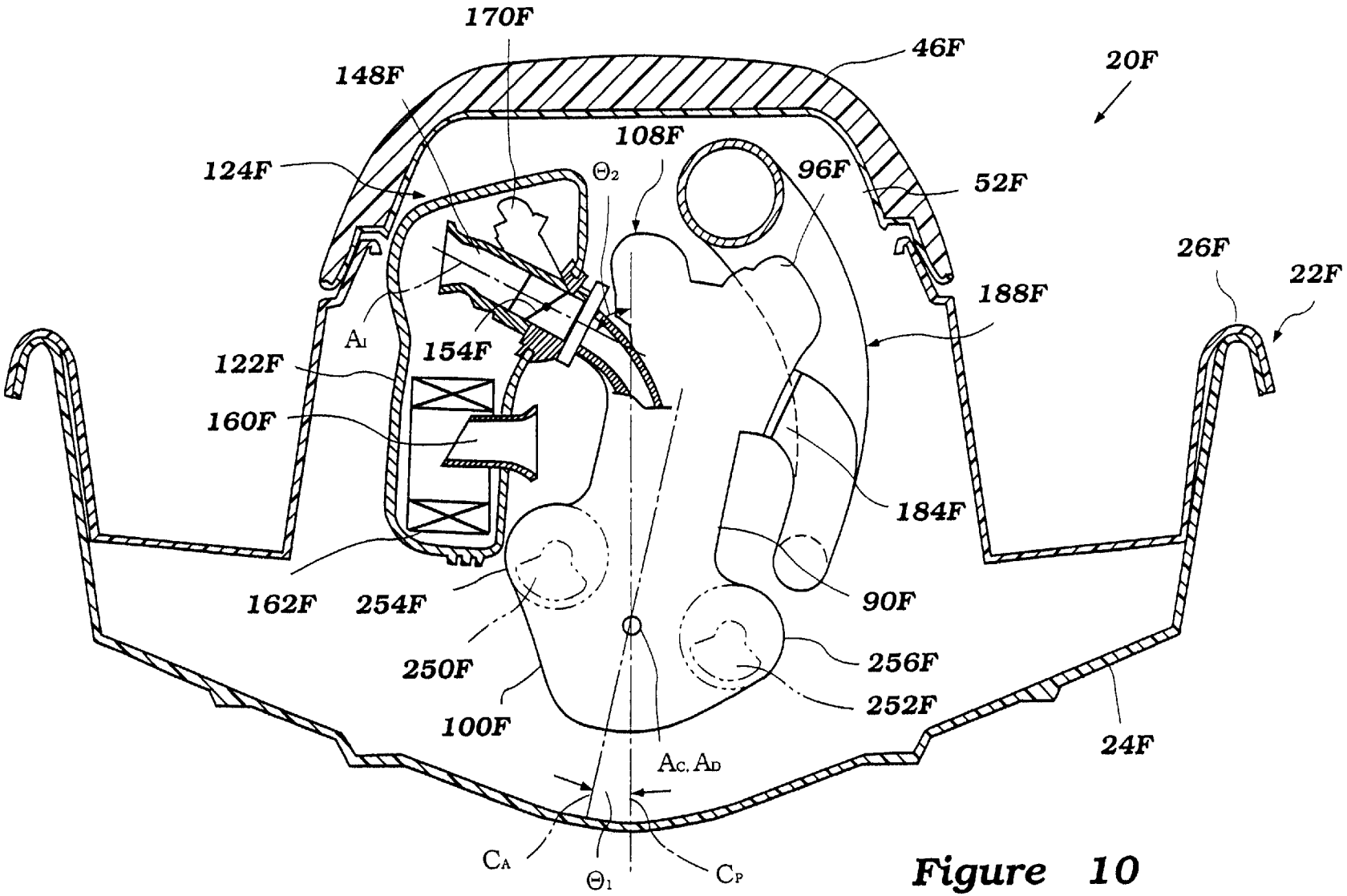
FIG. 10 is a schematic, cross-sectional rear view of another modification of the watercraft shown in FIG. 9, wherein a portion of an exhaust conduit of the exhaust system passes substantially longitudinally above the engine.

With reference to FIG. 10, a modification of the watercraft 20E of FIG. 9 is illustrated and is generally referred to with the reference numeral 20F. Like components to the watercraft 20E of FIG. 9 will be referred to with like reference numerals, except that an "F" will be added.

However, in the watercraft 20F, the horizontal portion of the exhaust conduits 188F, 190F extend over the top of the cylinder head member 96F and preferably intersect the cylinder axis $C_A$ in a similar manner to the watercraft 20C of FIG. 7.

Figure 11A:
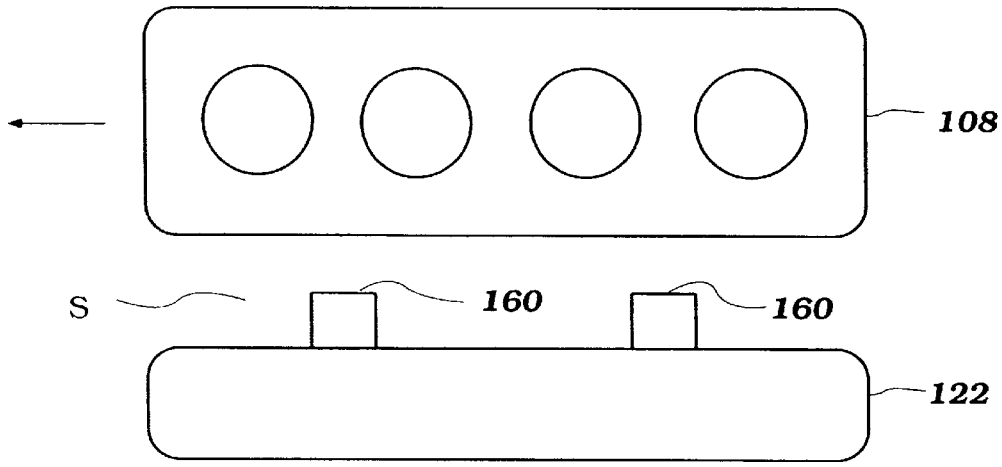
FIG. 11*a* is a schematic illustration of the engine and air intake box shown in FIG. 3. Each of the pair of inlet ducts extend directly into a space between the engine and air intake box and terminate in an inlet opening.
Figure 11B:
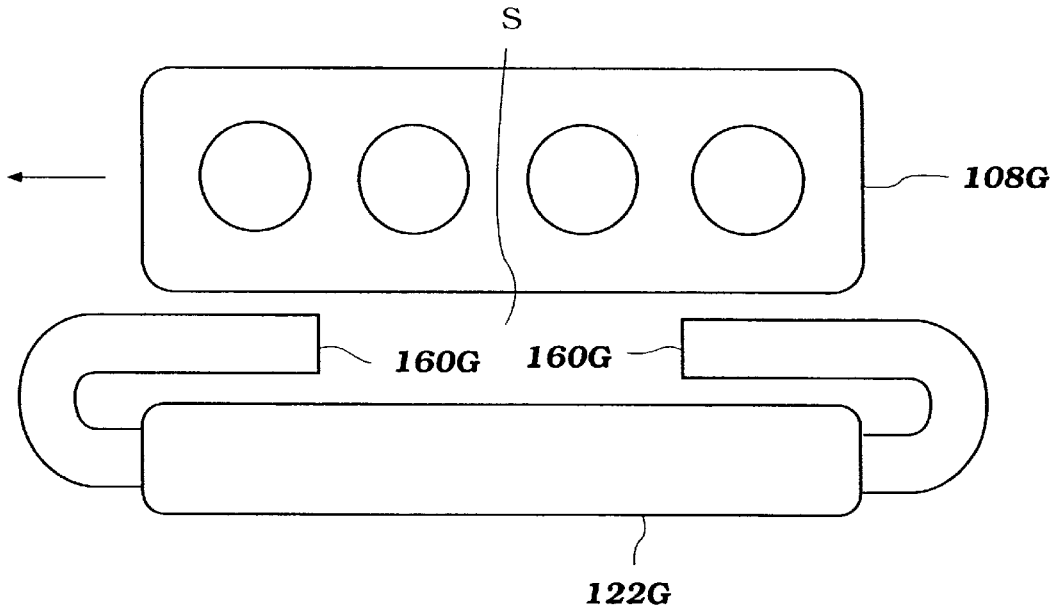
FIG. 11*b* illustrates a modification of the arrangement of FIG. 11*a*, wherein the inlet ducts extend from front and rear sides of the air intake box before curving into the space between the engine and air intake box.

FIGS. 11*a* and 11*b* are schematic illustrations of the air intake box 122 of the watercraft 20 shown in FIGS. 1–4 and a modification of the air intake box 122 of the watercraft 20, generally referred to by the reference numeral 122G. In addition, like components to the air intake box 122 will be referred to with like reference numerals, except that a "G" will be added.

As shown in FIG. 11*a*, the pair of intake ports 160 open directly into the space S defined between the air intake box 122 and the engine body 108. This arrangement, as mentioned above, substantially inhibits water which may be splashing within the engine compartment 52 from entering the plenum chamber 124 through the inlet ports 160.

As shown in FIG. 11*b*, the intake ports 160G exit from front and rear sides of the air intake box 122G, respectively. The air intake ports 160G extend in a longitudinal direction (e.g., parallel to the central plane $C_P$) before turning 180° and opening into the space S where the opening of the ports 160G are located.

Of course, the foregoing description is that of preferred embodiments of the present invention, and various changes and modifications may be made without departing from the spirit and scope of the invention, as defined by the appended claims.

What is claimed is:

1. A small watercraft comprising a hull having an engine compartment, an internal combustion engine disposed in the engine compartment, the engine having an engine body comprising a crankcase, a cylinder block and a cylinder head, the engine body including at least one cylinder bore defining a cylinder axis, an air induction system configured to guide air into a combustion chamber of the engine, the air induction system comprising a plenum chamber having a vertically extending portion, an exhaust system for guiding exhaust gases from the combustion chamber to the atmosphere, the exhaust system comprising an exhaust manifold and an exhaust conduit, the cylinder axis being canted with respect to a vertical central plane, the exhaust manifold and conduit being disposed substantially on a side of the central plane to which the cylinder axis is canted, the vertically extending portion of the plenum chamber being positioned on a side of the central plane opposite the exhaust conduit and extending substantially vertically from a position proximate the crankcase to a position proximate the cylinder head.

2. The small watercraft of claim 1, wherein the engine body additionally includes an exhaust passage communicating with the combustion chamber, the exhaust conduit extending in a downward direction from the exhaust passage, then curving to extend in an upward direction at least to a height proximate the cylinder head.

3. The small watercraft of claim 2, wherein the exhaust conduit extends to a height above the cylinder head and curves to extend in a rearward direction generally parallel to the central plane, the exhaust conduit passing through the cylinder axis.

4. The small watercraft of claim 1, wherein the engine body additionally includes an intake passage communicating with the combustion chamber, the intake passage defining an intake axis, the intake axis being canted less than or equal to about 60 degrees from the central plane.

5. The small watercraft of claim 1, wherein the plenum chamber comprises an inlet, the inlet opening into a space defined between the plenum chamber and the engine body.

6. The small watercraft of claim 5, wherein the engine additionally comprises a balance shaft extending generally parallel to the central plane, the engine body including a protruding portion sized and shaped to accommodate the balance shaft, the protruding portion and plenum chamber cooperating to substantially close off a lower end of the space.

7. The small watercraft of claim 5, wherein the plenum chamber additionally comprises a horizontal portion extending from an upper end of the vertical portion of the plenum chamber, the horizontal portion cooperating with the engine body to substantially close off an upper end of the space.

8. The small watercraft of claim 5, wherein the engine additionally comprises a balance shaft extending generally parallel to the central plane, the engine body including a protruding portion sized and shaped to accommodate the balance shaft, the protruding portion extending below the inlet opening.

9. The small watercraft of claim 5, wherein the plenum chamber additionally comprises a horizontal portion extending from an upper end of the vertical portion of the plenum chamber, the horizontal portion extending above the inlet opening.

10. The small watercraft of claim 5, wherein the inlet extends from one of a forward or rearward end of the plenum chamber and reverses direction before opening in the space.

11. The small watercraft of claim 10, additionally comprising a second inlet extending from the other of the forward or rearward end of the plenum chamber and reverses direction before opening in the space.

12. The small watercraft of claim 1, wherein the plenum chamber additionally comprises a horizontal portion originating from an upper end of the vertical portion of the plenum chamber and extending beyond the central plane.

13. The small watercraft of claim 1, wherein the engine additionally comprises a crankshaft journaled for rotation within the crankcase, an axis of the crankshaft being offset from the central plane.

14. The small watercraft of claim 13, wherein the watercraft addition comprises a jet propulsion unit driven by the engine, the jet propulsion unit comprising an impeller driven by an output shaft, wherein the crankshaft axis is at approximately the same vertical height along the central plane as an axis of the output shaft.

15. A small watercraft comprising a hull including a pedestal for supporting a seat assembly, the hull additionally having an engine compartment, an internal combustion engine disposed in the engine compartment, the engine having an engine body, an air induction system configured to guide air into a combustion chamber of the engine, the air induction system comprising an air intake box defining a plenum chamber, the plenum chamber extending substantially vertically along a side of the engine body, a side of the air intake box facing the pedestal including an access opening, the pedestal including a hull opening sized, shaped and positioned to permit access to the access opening of the air intake box.

16. The small watercraft of claim 15, wherein the hull additionally comprises a removable cover sized and shaped to cover the hull opening, the cover being curved outwardly away from the surface of the pedestal.

17. The small watercraft of claim 16, wherein an inner surface of the cover and an outer surface of the air intake box define a gap therebetween, the gap being of a distance sufficient to inhibit engine vibration from being transmitted to the hull by contact between the air intake box and the hull.

18. The small watercraft of claim 15, wherein the hull defines a vertically oriented, central longitudinal plane of the watercraft, the engine including at least one cylinder defining a cylinder axis, the watercraft additionally comprising an exhaust system for guiding exhaust gases from the combustion chamber to the atmosphere, the exhaust system comprising an exhaust conduit, the cylinder axis being canted with respect to the central plane, the exhaust conduit being disposed substantially on a side of the central plane to which the cylinder axis is canted, the plenum chamber being positioned on a side of the central plane opposite the exhaust conduit.

19. A small watercraft comprising a hull defining a vertically oriented, central longitudinal plane of the watercraft and including a pedestal for supporting a seat assembly, the hull additionally having an engine compartment, an internal combustion engine disposed in the engine compartment, the engine having an engine body, an exhaust system for guiding exhaust gases from the combustion chamber to the atmosphere, the exhaust system comprising an exhaust conduit having a portion passing along a side of the engine body, the pedestal including a hull opening, at least a portion of the exhaust conduit protruding outward through a plane defined by the hull opening, the hull additionally comprising a removable cover closing the hull opening, the cover being outwardly curved away from the pedestal to accommodate the exhaust conduit.

20. The small watercraft of claim 19, wherein an inner surface of the cover and an outer surface of the exhaust conduit define a gap therebetween, the gap being of a distance sufficient to inhibit engine vibration from being transmitted to the hull by contact between the exhaust conduit and the hull.

21. The small watercraft of claim 19, wherein the engine body includes at least one cylinder defining a cylinder axis, the cylinder axis being canted with respect to the central plane, the watercraft additionally comprising an air induction system configured to guide air into a combustion chamber of the engine, the air induction system comprising a plenum chamber, the exhaust conduit being disposed substantially on a side of the central plane to which the cylinder axis is canted, the plenum chamber being positioned on a side of the central plane opposite the exhaust conduit and extending substantially vertically from a position proximate the crankcase to a position proximate the cylinder head.

* * * * *